US010792729B2

(12) United States Patent
Nabesima et al.

(10) Patent No.: US 10,792,729 B2
(45) Date of Patent: Oct. 6, 2020

(54) CONTINUOUS CASTING MOLD AND METHOD FOR CONTINUOUS CASTING OF STEEL

(71) Applicant: JFE STEEL CORPORATION, Tokyo (JP)

(72) Inventors: Seiji Nabesima, Kurashiki (JP); Naomichi Iwata, Fukuyama (JP); Norichika Aramaki, Fukuyama (JP); Yuji Miki, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 143 days.

(21) Appl. No.: 14/410,394

(22) PCT Filed: Jun. 11, 2013

(86) PCT No.: PCT/JP2013/003654
§ 371 (c)(1),
(2) Date: Dec. 22, 2014

(87) PCT Pub. No.: WO2014/002409
PCT Pub. Date: Jan. 3, 2014

(65) Prior Publication Data

US 2015/0258603 A1 Sep. 17, 2015

(30) Foreign Application Priority Data

Jun. 27, 2012 (JP) ..... 2012-143839
Mar. 4, 2013 (JP) ..... 2013-041673

(51) Int. Cl.
*B22D 11/059* (2006.01)
*B22D 11/04* (2006.01)
(Continued)

(52) U.S. Cl.
CPC ..... *B22D 11/059* (2013.01); *B22D 11/001* (2013.01); *B22D 11/04* (2013.01);
(Continued)

(58) Field of Classification Search
CPC ..... B22D 27/04; B22D 11/04; B22D 11/059; B22D 11/22; B22D 11/001
See application file for complete search history.

(56) References Cited

U.S. PATENT DOCUMENTS 4,144,993 A * 3/1979 Ushio ..... B22D 11/059 164/138
4,787,228 A * 11/1988 Weisner ..... B22D 11/059 72/47

FOREIGN PATENT DOCUMENTS

CN 1137429 A 12/1996
CN 1465456 A 1/2004
(Continued)

OTHER PUBLICATIONS

English Machine Translation of JP-2001-105102.*
(Continued)

*Primary Examiner* — Kevin P Kerns
*Assistant Examiner* — Steven S Ha
(74) *Attorney, Agent, or Firm* — Oliff PLC

(57) ABSTRACT

A continuous casting mold according to the present invention has plural separate portions filled with a metal of low thermal conductivity formed by filling a metal having a thermal conductivity of 30% or less of that of copper into circular concave grooves having a diameter of 2 to 20 mm which are formed in the region of the inner wall surface of the copper mold from an arbitrary position higher than a meniscus to a position 20 mm or more lower than the meniscus, in which the filling thickness of the metal in the portions filled with the metal of low thermal conductivity is
(Continued)

equal to or less than the depth of the circular concave grooves and satisfies the relationship with the diameter of the portions filled with the metal of low thermal conductivity expressed by expression (1) below:

$$0.5 \leq H \leq d \quad (1).$$

11 Claims, 4 Drawing Sheets

(51) Int. Cl.
*B22D 11/108* (2006.01)
*B22D 11/00* (2006.01)
*B22D 11/12* (2006.01)
*B22D 27/04* (2006.01)

(52) U.S. Cl.
CPC ..... *B22D 11/108* (2013.01); *B22D 11/122* (2013.01); *B22D 27/04* (2013.01)

(56) References Cited

FOREIGN PATENT DOCUMENTS

| | | | |
|---|---|---|---|
| EP | 0 730 923 | A1 | 9/1996 |
| JP | A-1-170550 | | 7/1989 |
| JP | A-1-289542 | | 11/1989 |
| JP | A-2-6037 | | 1/1990 |
| JP | H02-155532 | A | 6/1990 |
| JP | A-6-297103 | | 10/1994 |
| JP | A-8-257694 | | 10/1996 |
| JP | A-9-206891 | | 8/1997 |
| JP | A-9-276994 | | 10/1997 |
| JP | H10-29043 | A | 2/1998 |
| JP | A-10-193041 | | 7/1998 |
| JP | A-10-296399 | | 11/1998 |
| JP | A-2001-105102 | | 4/2001 |
| JP | A-2005-297001 | | 10/2005 |

OTHER PUBLICATIONS

English Machine Translation of JP-H01-170550.*
International Search Report issued in International Application No. PCT/JP2013/003654 dated Jul. 9, 2013.
Jul. 9, 2013 Written Opinion of the International Searching Authority issued in PCT/JP2013/003654.
May 8, 2015 Extended Search Report issued in European Application No. 13 80 8490.0.
Apr. 5, 2016 Office Action issued in Korean Patent Application No. 10-2014-7034113.
Jan. 6, 2016 Office Action issued in Taiwanese Patent Application No. 102121730.
Oct. 25, 2016 Office Action issued in Taiwan Patent Application No. 105109501.
May 18, 2017 Office Action issued in Chinese Patent Application No. 201610161810.4.

* cited by examiner

CONTINUOUS CASTING MOLD AND METHOD FOR CONTINUOUS CASTING OF STEEL

TECHNICAL FIELD

The present invention relates to a continuous casting mold with which molten steel can be continuously cast with a surface crack on a cast piece caused by the inhomogeneous cooling of a solidified shell being prevented in the mold and to a method for continuously casting steel using the mold.

BACKGROUND ART

In a continuous casting process of steel, since molten steel which is injected into a mold is cooled using a water-cooled mold, a solidified layer (called "solidified shell") is formed as a result of the surface portion of the molten steel which is in contact with the mold being solidified. A cast piece having the solidified shell as an outer shell and a non-solidified layer inside the shell is continuously drawn in a downward direction through the mold while the cast piece is cooled using water sprays or air-water sprays which are installed on the downstream side of the mold. The central portion of the cast piece is solidified as a result of being cooled using the water sprays or the air-water sprays, and then cut into cast pieces having a specified length using, for example, a gas cutting machine.

In the case where inhomogeneous cooling occurs in the mold, there is a fluctuation in the thickness of a solidified shell in the casting direction and width direction of the cast piece. The solidified shell is subjected to stress caused by the shrinkage and deformation of the solidified shell. In the early solidification stage, since this stress is concentrated in a thin portion of the solidified shell, a crack occurs on the surface of the solidified shell due to this stress. Such a crack grows into a large surface crack afterward due to an external force caused by, for example, thermal stress and bending stress and leveling stress which are applied by the rolls of the continuous casting machine.

The surface crack on the cast piece becomes a surface defect of the steel product in the subsequent rolling process. Therefore, in order to prevent the surface defect of the steel product from occurring, it is necessary to remove the surface crack at the cast piece stage by performing scarfing or polishing on the surface of the cast piece.

Inhomogeneous solidification in the mold tends to occur, in particular, in the case of steel having a C content of 0.08 to 0.17 mass %. In the case of steel having a C content of 0.08 to 0.17 mass %, a peritectic reaction occurs when solidification occurs. It is considered that inhomogeneous solidification in the mold is caused by transformation stress due to a decrease in volume which occurs when transformation from δ iron (ferrite phase) to γ iron (austenite phase) occurs due to this peritectic reaction. That is, since the solidified shell is deformed due to strain caused by this transformation stress, the solidified shell is detached from the inner wall surface of the mold due to this deformation. Since the portion which is detached from the inner wall surface of the mold becomes less likely to be cooled through the mold, the thickness of the solidified shell in this portion which is detached from the inner wall surface of the mole (this portion which is detached from the inner wall surface of the mold is called a "depression") is decreased. It is considered that, since the thickness of the solidified shell is decreased, surface crack occurs due to the stress described above being concentrated in this portion.

In particular, in the case where a cast piece drawing speed is increased, since there is an increase in average thermal flux from the solidified shell to the cooling water of the mold (the solidified shell is rapidly cooled), and also since the distribution of thermal flux becomes irregular and inhomogeneous, there is a tendency for the number of cracks occurring on the surface of the cast piece to increase. Specifically, in the case of a machine for continuously casting a slab having a cast-piece thickness of 200 mm or more, a surface crack tends to occur when the cast piece drawing speed is 1.5 m/min or more.

In the past, there have been experiments in which mold powder having a chemical composition which tends to cause crystallization is used in order to prevent the occurrence of a surface crack on a cast piece of a steel grade (called "medium-carbon steel") in which a peritectic reaction described above tends to occur (for example, refer to Patent Literature 1). This is based on the fact that, in the case of mold powder having a chemical composition which tends to cause crystallization, since there is an increase in the thermal resistance of a mold powder layer, a solidified shell is slowly cooled. That is, this is because there is a decrease in stress applied to the solidified shell due to slow cooling, which results in a surface crack being less likely to occur. However, with only the effect of slow cooling through the use of mold powder, since there is an insufficient improvement in inhomogeneous solidification, it is impossible to prevent a crack from occurring in the case of a steel grade having a large transformation quantity.

Therefore, in order to prevent the occurrence of a surface crack on a cast piece, there have been many methods proposed in which a continuous casting mold is designed for slow cooling. For example, Patent Literature 2 and Patent Literature 3 disclose methods in which, in order to prevent a surface crack from occurring, concave portions (grooves or circular holes) are formed on the inner wall surface of the cast mold so that air gaps are formed in order to realize slow cooling. However, with these methods, there is a problem in that, in the case where the width of the grooves is large, since mold powder flows into the inside of the grooves, air gaps are not formed, which results in the effect of slow cooling not being realized.

In addition, there have also been methods proposed in which the degree of inhomogeneous solidification is decreased by providing a regular distribution of thermal conduction as a result of mold powder flowing into concave portions (vertical grooves, grid grooves or circular holes) which are formed on the inner wall surface of a mold (for example, refer to Patent Literature 4 and Patent Literature 5). However, with these methods, there is a problem in that, in the case where an insufficient amount of mold powder flows into the concave portions, constrained breakout occurs due to molten steel flowing into the concave portions, or in that constrained breakout occurs due to mold powder that is removed from the concave portions when casting is performed and due to molten steel flowing into the concave portions left by the separated mold powder.

In addition, there have also been methods proposed in which, in the case where air gaps are formed on the inner wall surface of a mold, the width of grooves or the diameter of circular holes in a shot blasted region or a region of machined concave portions of the inner wall surface of a mold is decreased (for example, refer to Patent Literature 6 and Patent Literature 7). With these methods, since mold powder does not flow into the grooves or circular holes in the shot blasted region or the region of machined concave portions due to an interfacial tension effect, air gaps are maintained. However, since the depth of the air gaps decreases due to the abrasion of the mold, there is a problem in that this effect gradually weakens.

On the other hand, in order to decrease the degree of inhomogeneous solidification by providing a regular distribution of thermal conduction, there have been methods proposed in which grooves (vertical grooves or grid grooves) are formed on the inner wall surface of a mold and the grooves are filled with a metal of low thermal conductivity (for example, refer to Patent Literature 8 and Patent Literature 9). With these methods, there is a problem in that, since stress, caused by a difference in the thermal strain between a metal of low thermal conductivity and copper (mold) is applied to the interface between the vertical grooves or the grid grooves and the copper plate and the intersections of the grid grooves, cracks occur on the surface of the mold copper plate.

CITATION LIST

Patent Literature

[PTL 1] Japanese Unexamined Patent Application Publication No. 2005-297001
[PTL 2] Japanese Unexamined Patent Application Publication No. 6-297103
[PTL 3] Japanese Unexamined Patent Application Publication No. 9-206891
[PTL 4] Japanese Unexamined Patent Application Publication No. 9-276994
[PTL 5] Japanese Unexamined Patent Application Publication No. 10-193041
[PTL 6] Japanese Unexamined Patent Application Publication No. 8-257694
[PTL 7] Japanese Unexamined Patent Application Publication No. 10-296399
[PTL 8] Japanese Unexamined Patent Application Publication No. 1-289542
[PTL 9] Japanese Unexamined Patent Application Publication No. 2-6037

SUMMARY OF INVENTION

Technical Problem

The present invention has been completed in view of the situation described above, and an object of the present invention is to provide a continuous casting mold with which a surface crack due to the inhomogeneous cooling of a solidified shell in the early solidification stage and a surface crack due to a variation in the thickness of a solidified shell which is caused by transformation from δ iron to γ iron in a medium-carbon steel in which a peritectic reaction tends to occur can be prevented without the occurrence of constrained breakout or a decrease in the life of the mold due to the surface crack on the mold, by forming plural separate portions having a thermal conductivity lower than that of copper on the inner wall surface of the continuous casting mold and to provide a method for continuously casting steel using the continuous casting mold.

Solution to Problem

The subject matter of the present invention in order to solve the problems described above is as follows.

[1] A continuous casting mold, the mold having a plurality of separate portions filled with a metal of low thermal conductivity that are formed by filling a metal having a thermal conductivity of 30% or less of that of copper into circular concave grooves having a diameter of 2 mm or more and 20 mm or less or quasi-circular concave grooves having an equivalent circle diameter of 2 mm or more and 20 mm or less which are formed in the region of the inner wall surface of the water-cooled copper mold from an arbitrary position higher than a meniscus to a position 20 mm or more lower than the meniscus, in which the filling thickness of the metal in the portions filled with a metal of low thermal conductivity is equal to or less than the depth of the circular concave grooves or the quasi-circular concave grooves and satisfies the relationship with the diameter or equivalent circle diameter of the portions filled with a metal of low thermal conductivity expressed by expression (1) below:

$$0.5 \leq H \leq d \quad (1),$$

where H represents the filling thickness (mm) of the metal and d represents the diameter (mm) or equivalent circle diameter (mm) of the portions filled with the metal of low thermal conductivity in expression (1).

[2] The continuous casting mold according to item [1] above, in which the inner wall surface of the water-cooled copper mold is coated with a Ni-alloy coated layer having a thickness of 2.0 mm or less, and the portions filled with the metal of low thermal conductivity are covered with the coated layer.

[3] The continuous casting mold according to item [1] or [2] above, in which a distance between the portions filled with the metal of low thermal conductivity satisfies the relationship with the diameter or equivalent circle diameter of the portions filled with the metal of low thermal conductivity expressed by expression (2) below:

$$P \geq 0.25 \times d \quad (2),$$

where P represents the distance (mm) between the portions filled with the metal of low thermal conductivity and d represents the diameter (mm) or equivalent circle diameter (mm) of the portions filled with the metal of low thermal conductivity in expression (2).

[4] The continuous casting mold according to item [3] above, in which the distance between the portions filled with the metal of low thermal conductivity varies in the width direction or casting direction of the mold within the range satisfying the relationship expressed by expression (2) above.

[5] The continuous casting mold according to any one of items [1] to [4] above, in which the portions filled with the metal of low thermal conductivity constitutes, in terms of area ratio, 10% or more of the region in which the portions filled with the metal of low thermal conductivity are formed on the inner wall surface of the copper mold.

[6] The continuous casting mold according to any one of items [1] to [5] above, in which a distance in the casting direction within the lower part of the mold out of the region in which the portions filled with the metal of low thermal conductivity are formed, between the lower edge of the region in which the portions filled with the metal of low thermal conductivity are formed and the lower edge of the mold satisfies the relationship with a cast piece drawing speed when ordinary casting is performed expressed by expression (3) below:

$$L \geq Vc \times 100 \quad (3),$$

where L represents the distance (mm) between the lower edge of the region in which the portions filled with the metal of low thermal conductivity are formed and the lower edge of the mold and Vc represents the cast piece drawing speed (m/min) when ordinary casting is performed in expression (3).

[7] The continuous casting mold according to any one of items [1] to [6] above, in which the diameter or equivalent circle diameter of the portions filled with the metal of low thermal conductivity varies in the width direction or casting direction of the mold within the range of 2 mm or more and 20 mm or less.

[8] The continuous casting mold according to any one of items [1] to [7] above, in which the thickness of the portions filled with the metal of low thermal conductivity varies in the width direction or casting direction of the mold within the range satisfying the relationship expressed by expression (1) above.

[9] A method for continuously casting steel, the method including using the continuous casting mold according to any one of items [1] to [8] above and continuously casting molten steel by injecting the molten steel in a tundish into the continuous casting mold.

[10] The method for continuously casting steel according to item [9] above, the method including using the continuous casting mold, in which the region in which the portions filled with the metal of low thermal conductivity are formed includes a position lower than the meniscus and at a distance from the meniscus equal to or more than a distance (R) derived using expression (4) below depending on the cast piece drawing speed when ordinary casting is performed, in which the cast piece drawing speed when ordinary casting is performed is 0.6 m/min or more, and in which mold powder having a crystallization temperature of 1100° C. or lower and a basicity ((CaO by mass %)/($SiO_2$ by mass %)) of 0.5 or more and 1.2 or less is used:

$$R=2\times Vc\times 1000/60 \quad (4),$$

where R represents the distance (mm) from the meniscus and Vc represents the cast piece drawing speed (m/min) when ordinary casting is performed in expression (4).

[11] The method for continuously casting steel according to item [9] or [10] above, in which the molten steel of a medium-carbon steel having a C content of 0.08 mass % or more and 0.17 mass % or less is continuously cast at a cast piece drawing speed of 1.5 m/min or more to form a cast slab having a thickness of 200 mm or more.

Advantageous Effects of Invention

According to the present invention, since plural portions filled with a metal of low thermal conductivity are arranged in the width direction and casting direction of a continuous casting mold in a region in the vicinity of a meniscus including the meniscus, the thermal resistance of the continuous casting mold increases and decreases regularly and periodically in the width direction and casting direction of the mold in the vicinity of the meniscus. Therefore, the thermal flux from a solidified shell to the continuous casting mold increases and decreases regularly and periodically in the vicinity of the meniscus, that is, in the early solidification stage. As a result of such regular and periodic increase and decrease in thermal flux, since there is a decrease in stress due to transformation from δ iron to γ iron and in thermal stress, there is a decrease in the amount of deformation of the solidified shell caused by these stresses. As a result of a decrease in the amount of deformation of the solidified shell, an inhomogeneous distribution of thermal flux caused by the deformation of the solidified shell is homogenized, and, since generated stress is de-concentrated, there is a decrease in the amounts of various strains, which results in a crack being prevented from occurring on the surface of the solidified shell.

DESCRIPTION OF EMBODIMENTS

Figure 1:
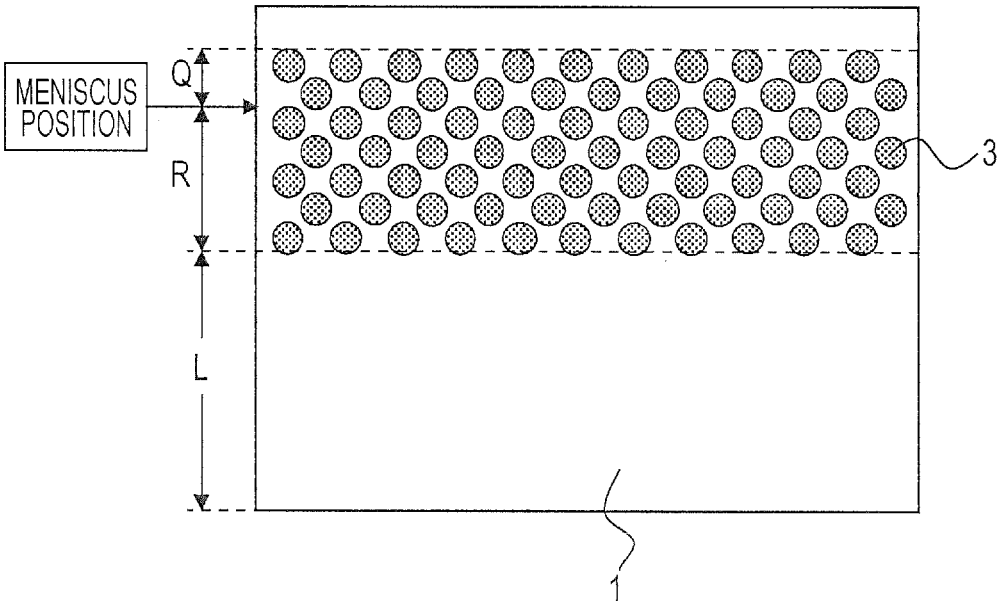
FIG. 1 is a schematic side view of a copper plate on the long side of a mold constituting a part of the continuous casting mold according to the present invention viewed from the inner wall surface side.
Figure 2:
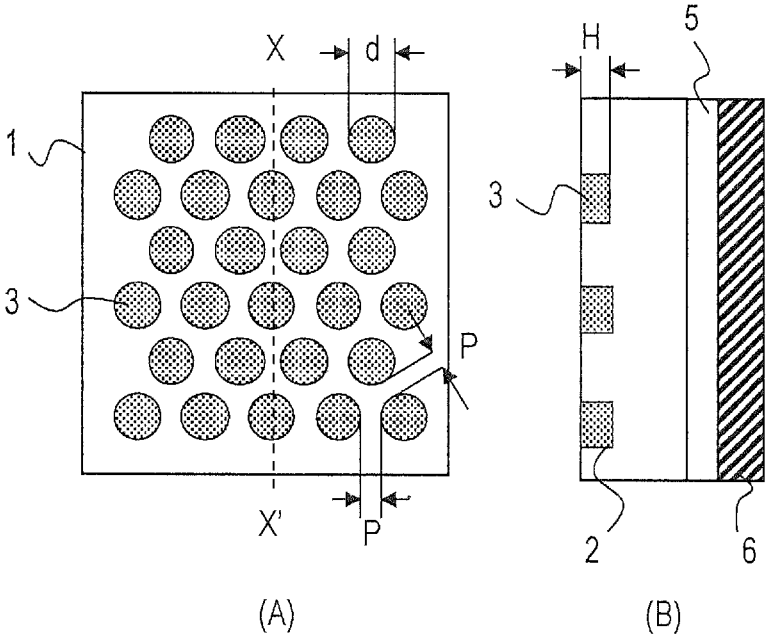
FIG. 2 is an enlarged view of the part of the copper plate on the long side of a mold in FIG. 1 in which portions filled with a metal of low thermal conductivity are formed.

Hereinafter, the present invention will be specifically described with reference to the accompanying drawings. FIG. 1 is a schematic side view of a copper plate on the long side of a mold constituting a part of the continuous casting mold according to the present invention, in which the copper plate on the long side of the mold, the copper plate having portions filled with a metal of low thermal conductivity on the inner wall surface, viewed from the inner wall surface side. FIG. 2 is an enlarged view of the part of the copper plate on the long side of a mold in FIG. 1 in which portions filled with a metal of low thermal conductivity are formed, in which FIG. 2(A) is a schematic side view viewed from the inner wall surface side and FIG. 2(B) is the cross-sectional view of FIG. 2(A) along the line X-X'.

The continuous casting mold illustrated in FIG. 1 is an example of a continuous casting mold used for casting a cast slab. A continuous casting mold for a cast slab consists of a combination of a pair of copper plates on the long sides of the mold and a pair of copper plates on the short sides of the mold. FIG. 1 illustrates the copper plate on the long side of the model among the copper plates. Although portions filled with a metal of low thermal conductivity are formed on the inner wall surface side of the copper plate on the inner wall surface on the short side of the mold similarly as is the case with the copper plate on the long side of the mold, the description of the copper plate on the short side of the mold will be omitted hereinafter. However, in the case of a cast slab, since stress concentration tends to occur in a solidified shell on the surface of the long side due to its shape, a crack tends to occur on the surface on the long side. Therefore, it is not always necessary to form portions filled with a metal of low thermal conductivity on the copper plate on the short side of the mold of a continuous casting mold for a cast slab.

As illustrated in FIG. 1, plural portions 3 filled with a metal of low thermal conductivity are formed in the region of the inner wall surface of the copper plate 1 on the long side of the mold from a position higher than the position in the copper plate 1 on the long side of the mold for a meniscus which is formed when ordinary casting is performed and at a distance of Q (distance (Q) is arbitrary) from the meniscus to a position located lower than the meniscus and at a distance of R from the meniscus. Here, "meniscus" means "the upper surface of molten steel in a mold".

These portions 3 filled with a metal of low thermal conductivity are formed, as illustrated in FIG. 2, by filling a metal having a thermal conductivity of 30% or less of that of copper (Cu) (hereinafter, referred to as a "metal of low thermal conductivity") into circular concave grooves 2 having a diameter (d) of 2 mm to 20 mm which are separately formed on the inner wall surface side of a copper plate 1 on the long side of the mold using, for example, a plating method or a thermal spraying method. Here, symbol L in FIG. 1 represents a distance in the casting direction within the lower part of the mold out of the region in which the portions 3 filled with a metal of low thermal conductivity are formed between the lower edge of the region in which the portions 3 filled with a metal of low thermal conductivity are formed and the lower edge of the mold. In addition, in FIG. 2, symbol 5 represents a flow channel of cooling water and symbol 6 represents a back plate.

Although, in FIG. 1 and FIG. 2, the shape of portions 3 filled with a metal of low thermal conductivity formed on the inner wall surface of a copper plate 1 on the long side of a mold is a circle, it is not necessary that the shape be limited to a circle. Any kind of shape may be used as long as the shape is one similar to a circle such as an ellipse which does not have a so-called "corner". However, even in the case of a shape similar to a circle, it is necessary that the equivalent circle diameter which is derived from the area of a portion 3 filled with a metal of low thermal conductivity having a shape similar to a circle be in a range of 2 to 20 mm.

Figure 3:
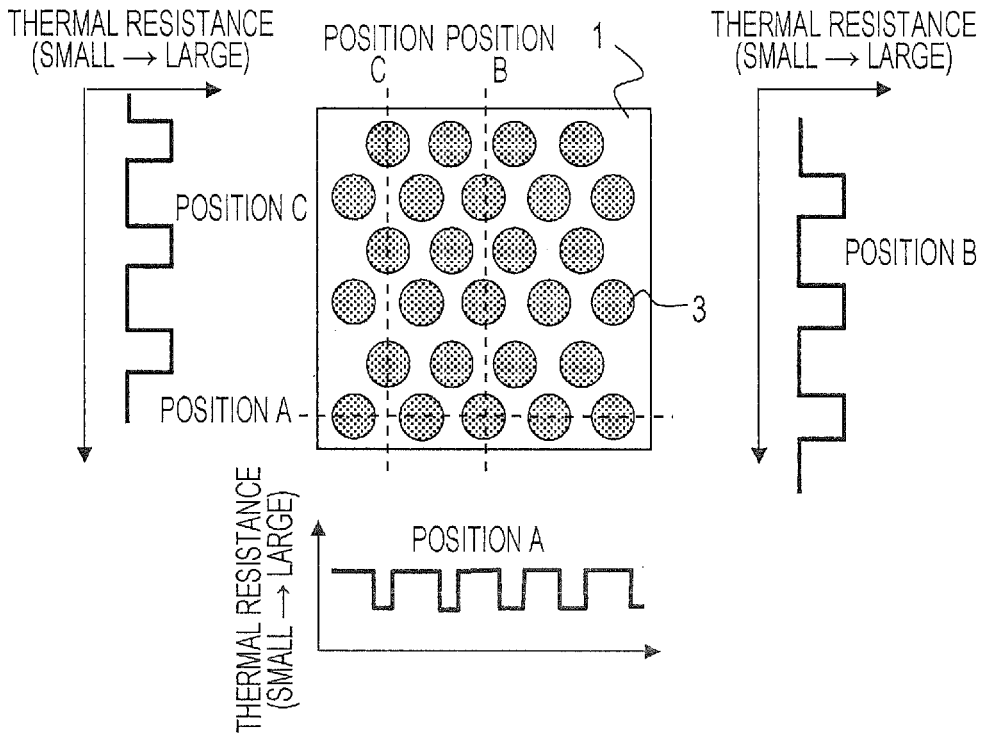
FIG. 3 is a conceptual diagram illustrating the thermal resistance distributions at three positions on a copper plate on the long side of a mold in accordance with the positions where portions filled with a metal of low thermal conductivity are formed.

By arranging plural portions 3 filled with a metal of low thermal conductivity in the width direction and casting direction of a continuous casting mold in a region in the vicinity of a meniscus including the meniscus, as illustrated in FIG. 3, the thermal resistance of the continuous casting mold increases and decreases regularly and periodically in the width direction of the mold and casting direction in the vicinity of the meniscus. Therefore, the thermal flux from a solidified shell to the continuous casting mold increases and decreases regularly and periodically in the vicinity of the meniscus, that is, in the early solidification stage. As a result of such regular and periodic increase and decrease in thermal flux, since there is a decrease in stress due to transformation from δ iron to γ iron (hereinafter referred to as "δ/γ transformation") and in thermal stress, there is a decrease in the amount of deformation of the solidified shell caused by these stresses. As a result of a decrease in the amount of deformation of the solidified shell, an inhomogeneous distribution of thermal flux caused by the deformation of the solidified shell is homogenized, and, since generated stress is de-concentrated, there is a decrease in the amounts of various strains, which results in a surface crack being prevented from occurring on the surface of the solidified shell. Incidentally, FIG. 3 is a conceptual diagram illustrating the thermal resistance distributions at three positions on a copper plate 1 on the long side of a mold in accordance with the positions where portions 3 filled with a metal of low thermal conductivity are formed. As illustrated in FIG. 3, thermal resistance comparatively increases at the positions where the portions 3 filled with a metal of low thermal conductivity are formed.

In consideration of an influence on the early stage of solidification, it is necessary that the region in which the portions 3 filled with a metal of low thermal conductivity are formed include a position 20 mm or more lower than the meniscus. As a result of the region in which the portions 3 filled with a metal of low thermal conductivity are formed including a position 20 mm or more lower than the meniscus, since the effect of a periodic variation in thermal flux caused by the portions 3 filled with a metal of low thermal conductivity is sufficiently realized, an effect of preventing the occurrence of a surface crack on a cast piece can be sufficiently realized even under conditions in which a surface crack tends to occur such as when high-speed casting is performed or when medium-carbon steel is cast. In the case where the region in which the portions 3 filled with a metal of low thermal conductivity are formed includes a position less than 20 mm lower than the meniscus, there is an insufficient effect of preventing the occurrence of a surface crack on a cast piece.

In addition, it is preferable that the region in which the portions 3 filled with a metal of low thermal conductivity are formed, in accordance with a cast piece drawing speed when ordinary casting is performed, include a position lower than the meniscus and at a distance from the meniscus equal to or more than a distance (R) which is derived from expression (4) below.

$$R=2\times Vc\times 1000/60 \quad (4),$$

where R represents the distance (mm) from the meniscus and Vc represents the cast piece drawing speed (m/min) when ordinary casting is performed in expression (4).

That is, the distance (R) relates to a time for a cast piece which has started being solidified to pass through the region in which the portions 3 filled with a metal of low thermal conductivity are formed, and it is preferable that the cast piece stay at least 2 seconds after solidification has started in the region in which the portions 3 filled with a metal of low thermal conductivity are formed. In order to allow a cast piece to stay at least 2 seconds after solidification has started in the region in which the portions 3 filled with a metal of low thermal conductivity are formed, it is necessary that the distance (R) satisfy expression (4).

By allowing a cast piece which has started being solidified to stay at least 2 seconds in the region in which the portions 3 filled with a metal of low thermal conductivity are formed, since the effect of a periodic variation in thermal flux caused by the portions 3 filled with a metal of low thermal conductivity is sufficiently realized, an effect of preventing the occurrence of a surface crack on a cast piece can be realized even under conditions in which a surface crack tends to occur such as when high-speed casting is performed or when medium-carbon steel is cast. In order to stably realize the effect of a periodic variation in thermal flux caused by the portions 3 filled with a metal of low thermal conductivity, it is preferable to ensure that the time taken for a cast piece to pass through the region in which the portions 3 filled with a metal of low thermal conductivity are formed is 4 seconds or more.

On the other hand, since the upper edge of the region in which the portions 3 filled with a metal of low thermal conductivity are formed may be located at any position as long as the position is higher than the meniscus, the distance (Q) may take any value larger than 0. However, since the meniscus moves in an up and down direction when casting is performed, in order to ensure that the upper edge of the region in which the portions 3 filled with a metal of low thermal conductivity are formed is always higher than the meniscus, it is preferable that the upper edge be located about 10 mm higher than the meniscus, more preferably about 20 mm higher than the meniscus. Incidentally, since the meniscus is generally located 60 to 150 mm lower than the upper edge of the copper plate 1 on the long side of the mold, it is appropriate that the region in which the portions 3 filled with a metal of low thermal conductivity be determined in consideration of this fact.

The shape of the portions 3 filled with a metal of low thermal conductivity formed on the inner wall surface of the copper plate 1 on the long side of a mold is a circle or one similar to a circle. Hereinafter, a shape similar to a circle will be referred to as a "quasi-circle". In the case where the shape of portions 3 filled with a metal of low thermal conductivity is a quasi-circle, a groove formed on the inner wall surface of the copper plate 1 on the long side of the mold in order to form the portions 3 filled with a metal of low thermal conductivity will be referred to as a "quasi-circle groove". Examples of a quasi-circle include an ellipse and a rectangle having corners having a shape of a circle or an ellipse which have no angulated corner, and, further, a shape such as a petal-shaped pattern may be used.

In the case of Patent Literature 8 and Patent Literature 9 where vertical grooves or grid grooves are formed and where a metal of low thermal conductivity is filled in the grooves, there is a problem in that, since stress caused by a difference in thermal strain between the metal of low thermal conductivity and copper is concentrated at the interface between the metal of low thermal conductivity and the copper and at the intersections of the grid portions, cracks occur on the surface of the mold copper plate. In contrast, in the case of the present invention where the shape of the portions 3 filled with a metal of low thermal conductivity is a circle or a quasi-circle, since stress is less likely to be concentrated at the interface due to the shape of the interface between the metal of low thermal conductivity and copper being a curved surface, the advantage that a crack is less likely to occur on the surface of a mold copper plate is realized.

It is necessary that the portions 3 filled with a metal of low thermal conductivity have a diameter or an equivalent circle diameter of 2 mm or more and 20 mm or less. As a result of the portions having a diameter or an equivalent circle diameter of 2 mm or more, since there is a sufficient effect of decreasing thermal flux in the portions 3 filled with a metal of low thermal conductivity, the effects described above can be realized. In addition, as a result of the portions having a diameter or an equivalent circle diameter of 2 mm or more, it is easy to fill the metal of low thermal conductivity into the circular concave grooves 2 or quasi-circular concave grooves (not illustrated) using a plating method or a thermal spraying method. On the other hand, as a result of the portions 3 filled with a metal of low thermal conductivity having a diameter or an equivalent circle diameter of 20 mm or less, since a decrease in thermal flux in the portions 3 filled with a metal of low thermal conductivity is suppressed, that is, since solidification delay in the portions 3 filled with a metal of low thermal conductivity is suppressed, stress concentration in a solidified shell at positions corresponding to the portions 3 is prevented, which results in a surface crack being prevented from occurring in the solidified shell. That is, since a surface crack occurs in the case where the diameter or the equivalent circle diameter is more than 20 mm, it is necessary that the portions 3 filled with a metal of low thermal conductivity have a diameter or an equivalent circle diameter of 20 mm or less. Here, in the case where the shape of the portions 3 filled with a metal of low thermal conductivity is a quasi-circle, the equivalent circle diameter of this quasi-circle is calculated using equation (5) below.

$$\text{equivalent circle diameter}=(4\times S/\pi)^{1/2} \quad (5),$$

where S represents the area ($mm^2$) of a portion 3 filled with a metal of low thermal conductivity in equation (5).

Figure 4:
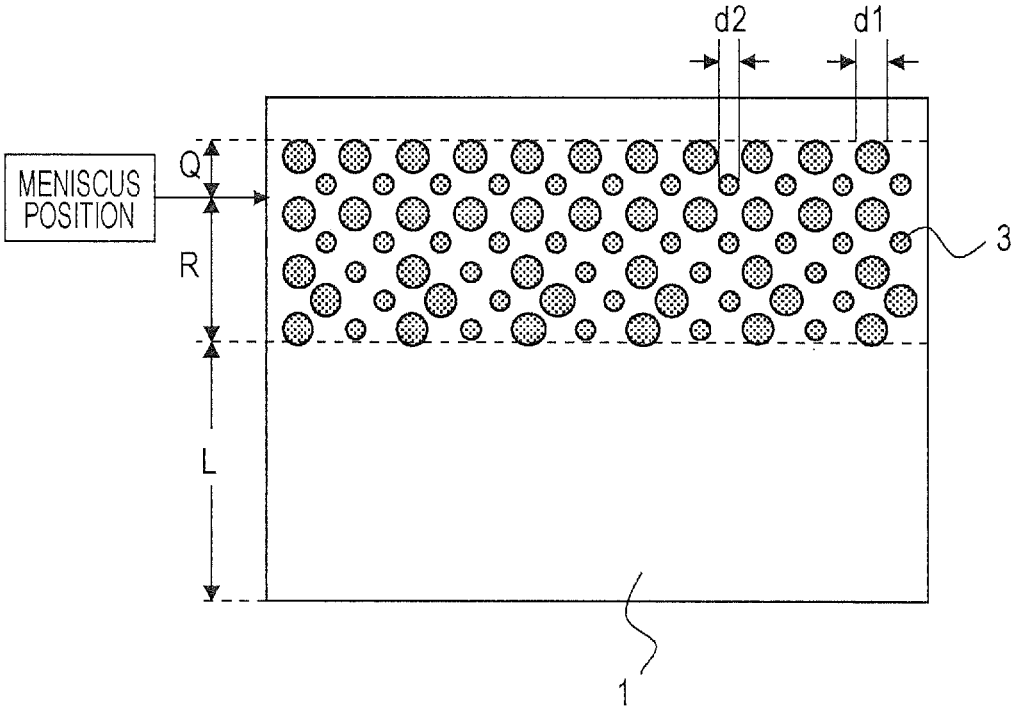
FIG. 4 is a schematic side view of a copper plate on the long side of a mold constituting a part of the continuous casting mold according to the present invention, in which the portions filled with a metal of low thermal conductivity, and having different diameters that vary in the mold width direction and the casting direction, viewed from the inner wall surface side.

Although the portions 3 filled with a metal of low thermal conductivity of the same shape in the casting direction or the mold width direction are formed in FIG. 1, it is not necessary, in the present invention, that portions 3 filled with a metal of low thermal conductivity of the same shape be formed. As long as the diameter or equivalent circle diameter of the portions 3 filled with a metal of low thermal conductivity is in a range of 2 mm or more and 20 mm or less, the diameter of the portions 3 filled with a metal of low thermal conductivity may vary in the casting direction or width direction of the mold as illustrated in FIG. 4 (diameter d1>diameter d2 in FIG. 4). Also, in this case, it is possible to prevent the occurrence of a surface crack on a cast piece caused by the inhomogeneous cooling of a solidified shell in the mold. However, in the case where the diameter or equivalent circle diameter of the portions 3 filled with a metal of low thermal conductivity widely varies from place to place, since solidification delay occurs in a region in which the area ratio of the portions 3 filled with a metal of low thermal conductivity is locally high, there is concern that a surface crack may occur in the region. Therefore, it is more preferable that the diameter or the equivalent diameter be the same. FIG. 4 is a schematic side view of a copper plate on the long side of a mold constituting a part of the continuous casting mold according to the present invention, in which the diameter of the portions filled with a metal of low thermal conductivity varies in the mold width direction and the casting direction, viewed from the inner wall surface side.

It is necessary that the thermal conductivity of metal of low thermal conductivity to be filled into circle grooves or quasi-circle grooves be 30% or less of the thermal conductivity of copper (about 380 W/(m·K)). By using metal of low thermal conductivity of 30% or less of the thermal conductivity of copper, since the effect of a periodic variation in thermal flux caused by the portions 3 filled with a metal of low thermal conductivity is sufficiently realized, an effect of preventing the occurrence of a surface crack on a cast piece can be sufficiently realized even under condition in which a surface crack of cast piece tends to occur such as when high-speed casting is performed or when medium-carbon steel is cast. Ideal examples of metal of low thermal conductivity used in the present invention include nickel (Ni, having a thermal conductivity of about 80 W/(m·K)) and nickel alloy which are easily used in a plating method or a thermal spraying method.

In addition, it is necessary that the filling thickness (H) of the portions 3 filled with a metal of low thermal conductivity be 0.5 mm or more. As a result of the filling thickness being 0.5 mm or more, since there is a sufficient effect of decreasing thermal flux in the portions 3 filled with a metal of low thermal conductivity, the effects described above can be realized.

In addition, it is necessary that the filling thickness of the portions 3 filled with a metal of low thermal conductivity be equal to or less than the diameter or equivalent circle diameter of the portions 3 filled with a metal of low thermal conductivity. Since the filling thickness of the portions 3 filled with a metal of low thermal conductivity is equal to or less than the diameter or equivalent circle diameter of the portions 3 filled with a metal of low thermal conductivity, it is easy to use the metal of low thermal conductivity as a filling in the circular concave grooves or quasi-circular concave grooves using a plating method or a thermal spraying method, and a gap or a crack does not occur at the interface between the filled metal of low thermal conductivity and the mold copper plate. In the case where a gap or a crack occurs at the interface between the filled metal of low thermal conductivity and the mold copper plate, the crack or avulsion of the filled metal of low thermal conductivity occurs, which results in a decrease in mold life and a crack in a cast piece, and, further, constrained breakout. That is, it is necessary that the filling thickness of the portions 3 filled with a metal of low thermal conductivity satisfy expression (1) below.

$$0.5 \leq H \leq d \quad (1),$$

where H represents the filling thickness (mm) of the metal and d represents the diameter (mm) of circular concave grooves or equivalent circle diameter (mm) of quasi-circular concave grooves in expression (1). In this case, the filling thickness of the metal is equal to or less than the depth of the circular concave grooves or the quasi-circular concave grooves.

Incidentally, the upper limit of the filling thickness (H) of the portions 3 filled with a metal of low thermal conductivity is determined depending on the diameter (d) of the circular concave grooves. However, since the effects described above become saturated in the case where the filling thickness (H) is more than 10.0 mm, it is preferable that the filling thickness (H) be equal to or less than the diameter (d) of the circular concave grooves and be 10.0 mm or less.

Figure 5:
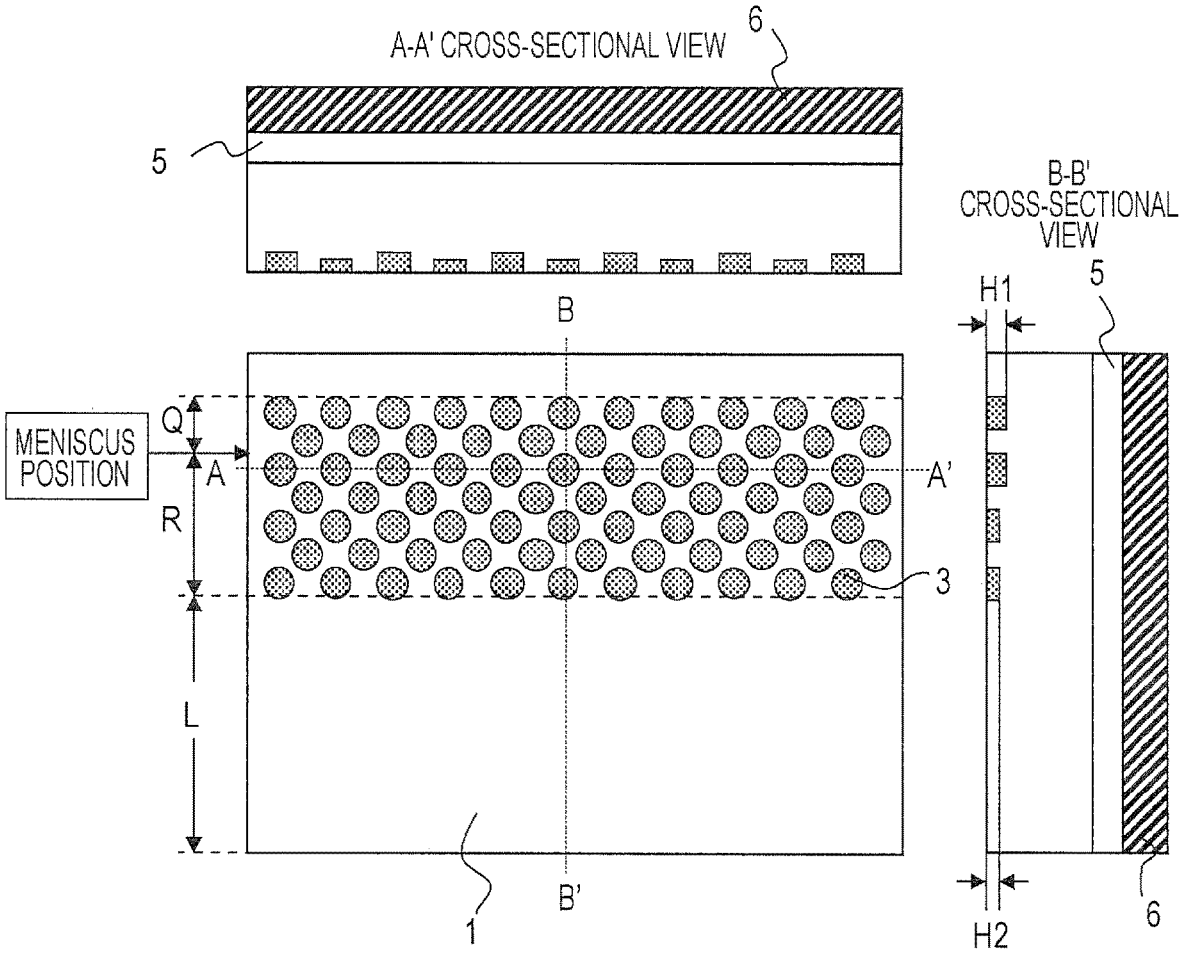
FIG. 5 is a schematic side view of a copper plate on the long side of a mold constituting a part of the continuous casting mold according to the present invention, in which the portions filled with a metal of low thermal conductivity, and having different thicknesses that vary in the mold width direction and the casting direction, viewed from the inner wall surface side, and its cross-sectional views along the lines A-A' and B-B'.

In the present invention, it is not necessary that portions 3 filled with a metal of low thermal conductivity of the same thickness be arranged in the casting direction and width direction of the mold. As long as the thickness of the portions 3 filled with a metal of low thermal conductivity is within the range expressed by expression (1) above, the thickness of the portions 3 filled with a metal of low thermal conductivity may vary in the casting direction or width direction of the mold as illustrated in FIG. 5 (thickness H1>thickness H2 in FIG. 5). Also, in this case, it is possible to prevent the occurrence of a surface crack on a cast piece caused by the inhomogeneous cooling of a solidified shell in the mold. However, in the case where the thickness of the portions 3 filled with a metal of low thermal conductivity widely varies from place to place, since solidification delay occurs in a region in which the thickness of the portions 3 filled with a metal of low thermal conductivity is locally high, there is concern that a surface crack may occur in the region. Therefore, it is more preferable that the thickness be constant. FIG. 5 is a schematic side view of a copper plate on the long side of a mold constituting a part of the continuous casting mold according to the present invention, in which the thickness of the portions filled with a metal of low thermal conductivity varies in the mold width direction and the casting direction, viewed from the inner wall surface side, and its cross-sectional views along the lines A-A' and B-B'.

In addition, it is preferable that a distance between the portions filled with a metal of low conductivity be 0.25 times or more of the diameter or equivalent circle diameter of the portions 3 filled with a metal of low thermal conductivity. That is, it is preferable that a distance between the portions 3 filled with a metal of low thermal conductivity satisfy the relationship with the diameter or equivalent circle diameter of the portions filled with a metal of low thermal conductivity expressed by expression (2) below.

$$P \geq 0.25 \times d \quad (2),$$

where P represents the distance (mm) between the portions filled with a metal of low thermal conductivity and d represents the diameter (mm) or equivalent circle diameter (mm) of the portions 3 filled with a metal of low thermal conductivity in expression (2).

Here, "a distance between the portions filled with a metal of low thermal conductivity" refers to the shortest distance between the edges of the adjacent portions 3 filled with a metal of low conductivity as illustrated in FIG. 2. As a result of the distance between the portions filled with a metal of low thermal conductivity being equal to or more than "0.25×d", since the distance is sufficiently large so that the difference in thermal flux between the portions 3 filled with a metal of low thermal conductivity and the copper portion (in which portions 3 filled with a metal of low thermal conductivity are not formed) is sufficiently large, the effects described above can be realized. Although there is no particular limitation on the upper limit of the distance between the portions filled with a metal of low thermal conductivity, since there is a decrease in the area ratio of the portions 3 filled with a metal of low thermal conductivity in the case where this distance is excessively large, it is preferable that this distance be equal to or less than "2.0×d".

Figure 6:
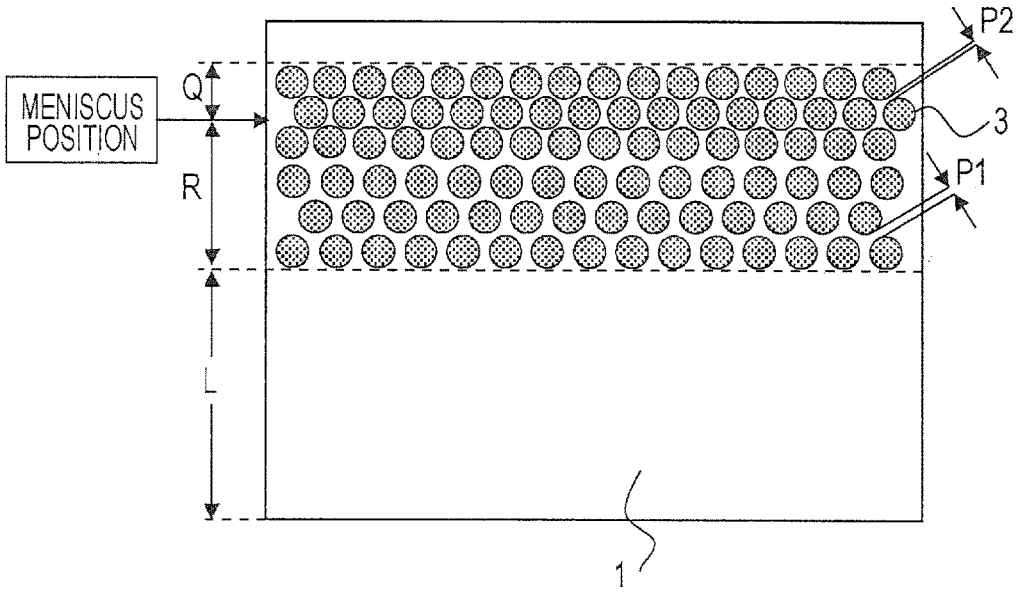
FIG. 6 is a schematic side view of a copper plate on the long side of a mold constituting a part of the continuous casting mold according to the present invention, in which the portions filled with a metal of low thermal conductivity are formed such that the distance between the portions filled with a metal of low thermal conductivity varies in the mold width direction and the casting direction, viewed from the inner wall surface side.

Although the portions 3 filled with a metal of low thermal conductivity are formed at a same interval in FIG. 1, it is not necessary, in the present invention, that the distance between the portions 3 filled with a metal of low thermal conductivity be constant. The distance between the portions 3 filled with a metal of low thermal conductivity may vary in the casting direction or width direction of the mold as illustrated in FIG. 6 (distance P1>distance P2 in FIG. 6). Also, in this case, it is preferable that the distance between the portions filled with a metal of low thermal conductivity satisfy the relationship expressed by expression (2). Also, in the case where the distance between the portions 3 filled with a metal of low thermal conductivity may vary in the casting direction or width direction of the mold, it is possible to prevent the occurrence of a surface crack on a cast piece caused by the inhomogeneous cooling of a solidified shell in the mold. However, in the case where the distance between the portions 3 filled with a metal of low thermal conductivity widely varies in one mold, since solidification delay occurs in a region in which the area ratio of the portions 3 filled with a metal of low thermal conductivity is locally high, there is concern that a surface crack may occur in the region. Therefore, it is more preferable that the distance be constant. FIG. 6 is a schematic side view of a copper plate on the long side of a mold constituting a part of the continuous casting mold according to the present invention, in which the distance between the portions filled with a metal of low thermal conductivity varies in the mold width direction and the casting direction, viewed from the inner wall surface side.

It is preferable that the area ratio (ε) of the portions 3 filled with a metal of low thermal conductivity with respect to the region on wall surface of copper mold in which the portions 3 filled with a metal of low thermal conductivity are formed be 10% or more. As a result of this area ratio (ε) being 10% or more, since sufficient area which is constituted by the portions 3 filled with a metal of low thermal conductivity, the portions 3 having low thermal flux, is achieved, difference in thermal flux between the portions 3 filled with a metal of low thermal conductivity and the copper portion is achieved, which results in the effects described above being stably realized. Here, although there is no particular limitation on the upper limit of the area ratio (ε) which is constituted by the portions 3 filled with a metal of low thermal conductivity, as described above, since it is preferable that the distance between the portions filled with a metal of low thermal conductivity be equal to or more than "0.25×d", this condition may be used to determine the maximum area ratio (ε).

In addition, it is preferable that a distance in the casting direction within the lower part of the mold out of the region in which the portions 3 filled with a metal of low thermal conductivity are formed, that is, a distance between the lower edge of the region in which the portions filled with a metal of low thermal conductivity are formed and the lower edge of the mold satisfy the relationship with a cast piece drawing speed when ordinary casting is performed expressed by expression (3) below.

$$L \geq Vc \times 100 \quad (3),$$

where L represents the distance (mm) between the lower edge of the region in which the portions filled with a metal of low thermal conductivity are formed and the lower edge of the mold and Vc represents the cast piece drawing speed (m/min) when ordinary casting is performed in expression (3).

In the case where a distance (L) between the lower edge of the region in which the portions filled with a metal of low thermal conductivity are formed and the lower edge of the mold satisfies expression (3), since an area in which slow cooling is performed is limited to an appropriate area, and since, in particular, sufficient thickness of a solidified shell is achieved when a cast piece is drawn out of the mold even in the case where high-speed casting is performed, the occurrence of the bulging (a phenomenon in which a solidified shell is expanded due to the static pressure of the molten steel) and breakout of the cast piece can be prevented.

Although it is preferable that the portions 3 filled with a metal of low thermal conductivity are arranged in a zigzag pattern as illustrated in FIG. 1, in the present invention, the arrangement pattern of the portions 3 filled with a metal of low thermal conductivity is not limited to a zigzag pattern, and any arrangement may be used. However, it is preferable that the pattern be selected so that the distance (P) between the above described portions filled with a metal of low thermal conductivity and the area ratio (ε) which is constituted by the portions 3 filled with a metal of low thermal conductivity described above satisfy the conditions described above.

Incidentally, although the portions 3 filled with a metal of low thermal conductivity are basically formed in the mold copper plates on both the long side and short side of the continuous casting mold, in the case of a cast slab in which the ratio of the long side length of the cast piece to the short side length of the cast piece is large, since a surface crack tends to occur on the long side of the cast piece, the effects of the present invention can be realized even in the case where the portions 3 filled with a metal of low thermal conductivity are formed only on the long side.

Figure 7:
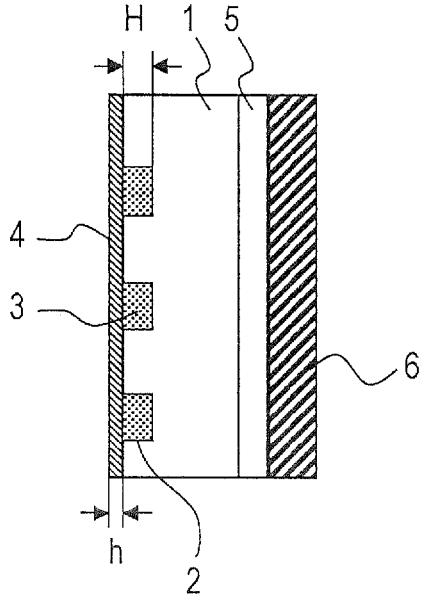
FIG. 7 is a schematic view illustrating an example in which a coated layer is formed on the inner wall surface of a copper mold in order to protect the surface of the copper mold.

In addition, as illustrated in FIG. 7, it is preferable that a coated layer 4 is formed on the inner wall surface of a copper mold on which the portions 3 filed with a metal of low thermal conductivity be formed in order to prevent abrasion caused by a solidified shell and a crack on the mold surface due to a thermal history. It is satisfactory to form the coated layer 4 by performing plating using common nickel-based alloy such as a nickel-cobalt alloy (Ni—Co alloy). However, it is preferable that the thickness (h) of the coated layer 4 be 2.0 mm or less. As a result of the thickness (h) of the coated layer 4 being 2.0 mm or less, since there is a decrease in the influence of the coated layer 4 on thermal flux, the effects of a periodic variation in thermal flux caused by the portions 3 filled with meal of low thermal conductivity can be sufficiently realized. Incidentally, FIG. 7 is a schematic view illustrating an example in which a coated layer is formed on the inner wall surface of a copper mold in order to protect the surface of the copper mold.

When a cast piece is continuously cast using the continuous casting mold configured as described above, it is preferable that mold powder to be added in the mold have a crystallization temperature of 1100° C. or lower and a basicity ((CaO by mass %)/($SiO_2$ by mass %)) is in a range of 0.5 or more and 1.2 or less. Here, "crystallization temperature" refers to a temperature at which mold powder is crystallized in the course of the reheating of vitrified mold powder which has been formed by rapidly cooling molten mold powder. In contrast, a temperature at which there is a sharp increase in the viscosity of molten mold powder in the course of the cooling of molten mold powder is referred to as "solidification temperature". Therefore, the crystallization temperature and solidification temperature of mold powder are different from each other, and the crystallization temperature is lower than the solidification temperature.

As a result of mold powder having a crystallization temperature of 1100° C. or lower and a basicity ((CaO by mass %)/($SiO_2$ by mass %)) of 1.2 or less, since mold powder is prevented from forming a layer fixing onto the mold wall, it is possible to minimize the influence of the mold powder layer on the effects of a regular and periodic variation in thermal flux caused by the portions 3 filled with a metal of low thermal conductivity. That is, it is possible to effectively apply a regular and periodic variation in thermal flux caused by the portions 3 filled with a metal of low thermal conductivity to a solidified shell. On the other hand, by maintaining a basicity ((CaO by mass %)/($SiO_2$ by mass %)) of mold powder of 0.5 or more, since there is not an increase in the viscosity of mold powder, it is ensured that a sufficient amount of mold powder flows into the gap between the mold and a solidified shell, which results in constrained breakout being prevented from occurring.

$Al_2O_3$, $Na_2O$, MgO, $CaF_2$, $Li_2O$, BaO, MnO, $B_2O_3$, $Fe_2O_3$, $ZrO_2$ and so forth may be added to mold powder used in the present invention in order to control a melting property. In addition, carbon may be added in order to control the melting speed of molten powder. Moreover, molten powder may contain inevitable impurities other than the chemical elements described above. However, it is preferable that the contents of fluorine (F), MgO and $ZrO_2$ that have promoting effect on crystallization of mold powder be respectively 10 mass % or less, 5 mass % or less and 2 mass % or less.

As described above, according to the present invention, since plural portions 3 filled with a metal of low thermal conductivity are arranged in the width direction and casting direction of a continuous casting mold in a region in the vicinity of a meniscus including the meniscus, the thermal resistance of the continuous casting mold increases and decreases regularly and periodically in the width direction and casting direction of the mold in the vicinity of the meniscus. Therefore, the thermal flux from a solidified shell to the continuous casting mold increases and decreases regularly and periodically in the vicinity of the meniscus, that is, in the early solidification stage. As a result of such regular and periodic increase and decrease in thermal flux, since there is a decrease in stress due to $\delta/\gamma$ transformation and in thermal stress, there is a decrease in the amount of deformation of the solidified shell caused by these stresses. As a result of a decrease in the amount of deformation of the solidified shell, an inhomogeneous distribution of thermal flux caused by the deformation of the solidified shell is homogenized, and, since generated stress is de-concentrated, there is a decrease in the amounts of various strains, which results in a crack being prevented from occurring on the surface of the solidified shell.

Here, although a continuous casting mold for a cast slab has been described above, the present invention is not limited to a continuous casting mold for a cast slab, the present invention may be applied to a continuous casting mold for a cast bloom or a cast billet in a manner described above.

Example 1

Medium-carbon steel (having a chemical composition containing C: 0.08 to 0.17 mass %, Si: 0.10 to 0.30 mass %, Mn: 0.50 to 1.20 mass %, P: 0.010 to 0.030 mass %, S: 0.005 to 0.015 mass % and Al: 0.020 to 0.040 mass %) was cast using water-cooled copper molds in which portions filled with a metal of low thermal conductivity were formed under various conditions on the inner wall surface, and tests were carried out in order to investigate the surface crack on the cast pieces. The inner space of the used water-cooled copper mold had a long side length of 1.8 m and a short side length of 0.26 m.

The length (=mold length) from the upper edge to the lower edge of the used water-cooled copper mold was 900 mm, and the position of a meniscus (the upper surface of molten steel in the mold) when ordinary casting is performed was set to be 100 mm lower than the upper edge of the mold. Firstly, circular concave grooves were formed in the region between a position 80 mm lower than the upper edge of the mold and a position 300 mm lower than the upper edge of the mold on the inner wall surface of the mold (the length of the region=220 mm). Subsequently, portions filled with a metal of low thermal conductivity were formed by filling nickel (having a thermal conductivity of 80 W/(m·K)) into the circular concave grooves using a plating method. At this time, in the case of some water-cooled copper molds prepared, the diameter (d) and filling thickness (H) of the portions filled with a metal of low thermal conductivity and distance (P) between the portions filled with a metal of low thermal conductivity in a region between a position 80 mm lower than the upper edge of the mold and a position 190 mm lower than the upper edge of the mold were different from those in the region between a position 190 mm lower than the upper edge of the mold and a position 300 mm lower than the upper edge of the mold. The filled depth of Ni in the circle concave grooves was equal to the depth of the circle concave grooves.

In addition, a water-cooled copper mold having portions filled with a metal of low thermal conductivity that were formed using a method similar to that described above, in the region between a position 80 mm lower than the upper edge of the mold and a position 750 mm lower than the upper edge of the mold (the length of the region=670 mm) was prepared.

Since the position of a meniscus in the mold was set to be 100 mm lower than the upper edge of the mold, in the case of molds where the lower edge of the region in which the portions filled with a metal of low thermal conductivity were formed was 300 mm lower than the upper edge of the mold, the distances (Q), (R), and (L) in FIG. 1 were respectively 20 mm, 200 mm, and 600 mm, and, in the case of molds where the lower edge of the region in which the portions filled with a metal of low thermal conductivity are formed was 750 mm lower than the upper edge of the mold, the distances (Q), (R), and (L) in FIG. 1 were respectively 20 mm, 650 mm, and 150 mm.

In the case where the depth of the circular concave grooves was large, portions filled with a metal of low thermal conductivity having the desired shape were formed on the inner wall surface of the mold by repeating plating and surface polishing several times. Subsequently, the whole inner wall surface of the mold was covered to form a coated layer of a Ni—Co alloy so that the coated layer thickness was 0.5 mm at the upper edge of the mold and 1.0 mm at the lower edge of the mold (the thickness of the coated layer of a Ni—Co alloy was about 0.6 mm in the portions filled with a metal of low thermal conductivity).

In addition, for comparison, a water-cooled copper mold that had no portion filled with a metal of low thermal conductivity and whose whole inner wall surface was covered with a coated layer of a Ni—Co alloy so that the coated layer thickness was 0.5 mm at the upper edge of the mold and 1.0 mm at the lower edge of the mold was prepared.

In a continuous casting operation, mold powder having a basicity ((CaO by mass %)/($SiO_2$ by mass %)) of 1.1, a solidification temperature of 1210° C., and a viscosity at 1300° C. of 0.15 Pa·s was used. This mold powder is within the preferable range according to the present invention. "Solidification temperature" means, as described above, a temperature at which there is a sharp increase in the viscosity of molten mold powder in the course of the cooling of molten mold powder. The position of the meniscus in the mold when ordinary casting is performed was set to be 100 mm lower than the upper edge of the mold and controlled to be present within the region in which the portions filled with a metal of low thermal conductivity were formed. In addition, a cast piece drawing speed when ordinary casting was performed was 1.7 to 2.2 m/min, and cast pieces which were used for the investigation of the surface crack on a cast piece were formed by ordinary casting at a cast piece drawing speed of 1.8 m/min in all the tests. Since the distance (R) between the meniscus and the lower edge of the region in which the portions filled with a metal of low thermal conductivity were formed were 200 mm or more, the distance (R) and the cast piece drawing speed (Vc) when ordinary casting was performed satisfied the relationship expressed by expression (4). The degree of superheat for molten steel in a tundish was 25° C. to 35° C.

After continuous casting had been finished, the surface on the long side of the cast piece was pickled in order to remove scale, and then the number of occurrences of the surface cracks was determined. The state in which the surface cracks of the cast piece of medium-carbon steel occurred is given in Table 1 and Table 2. The state in which the surface cracks of the cast piece occurred was evaluated on the basis of a value which was calculated by dividing the length of the portions of a cast piece in which surface cracks occurred by the length of the cast piece. Incidentally, in the "Note" columns of Table 1 and Table 2, a test within the range according to the present invention is referred to as an "Example", a test using a water-cooled copper mold out of the range according to the present invention despite having portions filled with a metal of low thermal conductivity is referred as a "Comparative example", and a test using a water-cooled copper mold having no portions filled with a metal of low thermal conductivity is referred as a "Conventional example".

TABLE 1

| Test No. | Filled Metal | Diameter d (mm) | Thickness H (mm) | Distance P (mm) | Area Ratio ε (%) | Distance R (mm) | Distance L (mm) | Filled Region (mm) | Drawing Speed Vc (m/min) | Cast Piece Surface Crack | State of Mold | Bulging of Cast Piece | Note |
|---|---|---|---|---|---|---|---|---|---|---|---|---|---|
| 1 | Ni | 2 | 0.5 | 1.0 | 40 | 200 | 600 | 220 | 1.8 | None | Good | None | Example |
| 2 | Ni | 2 | 1.0 | 2.0 | 23 | 200 | 600 | 220 | 1.8 | None | Good | None | Example |
| 3 | Ni | 2 | 2.0 | 4.0 | 10 | 200 | 600 | 220 | 1.8 | None | Good | None | Example |
| 4 | Ni | 4 | 1.0 | 2.0 | 40 | 200 | 600 | 220 | 1.8 | None | Good | None | Example |
| 5 | Ni | 4 | 2.0 | 4.0 | 23 | 200 | 600 | 220 | 1.8 | None | Good | None | Example |
| 6 | Ni | 4 | 4.0 | 8.0 | 10 | 200 | 600 | 220 | 1.8 | None | Good | None | Example |
| 7 | Ni | 6 | 0.5 | 1.5 | 58 | 200 | 600 | 220 | 1.8 | None | Good | None | Example |
| 8 | Ni | 6 | 2.0 | 3.0 | 40 | 200 | 600 | 220 | 1.8 | None | Good | None | Example |
| 9 | Ni | 6 | 2.0 | 6.0 | 23 | 200 | 600 | 220 | 1.8 | None | Good | None | Example |
| 10 | Ni | 6 | 3.0 | 6.0 | 23 | 200 | 600 | 220 | 1.8 | None | Good | None | Example |
| 11 | Ni | 6 | 6.0 | 12.0 | 10 | 200 | 600 | 220 | 1.8 | None | Good | None | Example |
| 12 | Ni | 10 | 2.0 | 5.0 | 40 | 200 | 600 | 220 | 1.8 | None | Good | None | Example |
| 13 | Ni | 10 | 4.0 | 10.0 | 23 | 200 | 600 | 220 | 1.8 | None | Good | None | Example |
| 14 | Ni | 10 | 8.0 | 15.0 | 15 | 200 | 600 | 220 | 1.8 | None | Good | None | Example |
| 15 | Ni | 20 | 2.0 | 10.0 | 40 | 200 | 600 | 220 | 1.8 | None | Good | None | Example |
| 16 | Ni | 20 | 5.0 | 20.0 | 23 | 200 | 600 | 220 | 1.8 | None | Good | None | Example |
| 17 | Ni | 2 | 1.0 | 5.0 | 7 | 200 | 600 | 220 | 1.8 | Little | Good | None | Example |
| 18 | Ni | 4 | 2.0 | 0.8 | 63 | 200 | 600 | 220 | 1.8 | Little | Good | None | Example |
| 19 | Ni | 4 | 4.0 | 10.0 | 7 | 200 | 600 | 220 | 1.8 | Little | Good | None | Example |
| 20 | Ni | 6 | 2.0 | 1.0 | 67 | 200 | 600 | 220 | 1.8 | Little | Good | None | Example |
| 21 | Ni | 6 | 3.0 | 14.0 | 8 | 200 | 600 | 220 | 1.8 | Little | Good | None | Example |
| 22 | Ni | 10 | 5.0 | 24.0 | 8 | 200 | 600 | 220 | 1.8 | Little | Good | None | Example |

TABLE 2

| Test No. | Filled Metal | Diameter d (mm) | Thickness H (mm) | Distance P (mm) | Area Ratio ε (%) | Distance R (mm) | Distance L (mm) | Filled Region (mm) | Drawing Speed Vc (m/min) | Cast Piece Surface Crack | State of Mold | Bulging of Cast Piece | Note |
|---|---|---|---|---|---|---|---|---|---|---|---|---|---|
| 23 | Ni | 20 | 4.0 | 4.0 | 63 | 200 | 600 | 220 | 1.8 | Little | Good | None | Example |
| 24 | Ni | 4 | 2.0 | 4.0 | 23 | 650 | 150 | 670 | 1.8 | None | Good | Occurred | Example |
| 25 | Ni | 4 | 2.0 | 6.0 | 15 | 200 | 600 | 110 (Upper) | 1.8 | None | Good | None | Example |
| | | 6 | 2.0 | 6.0 | 23 | | | 110 (Lower) | | | | | |
| 26 | Ni | 10 | 2.0 | 5.0 | 40 | 200 | 600 | 110 (Upper) | 1.8 | None | Good | None | Example |
| | | 10 | 2.0 | 10.0 | 23 | | | 110 (Lower) | | | | | |
| 27 | Ni | 10 | 4.0 | 10.0 | 23 | 200 | 600 | 110 (Upper) | 1.8 | None | Good | None | Example |
| | | 10 | 2.0 | 10.0 | 23 | | | 110 (Lower) | | | | | |
| 28 | Ni | 1.8 | 1.0 | 2.0 | 20 | 200 | 600 | 220 | 1.8 | Occurred | Good | None | Comparative Example |
| 29 | Ni | 2 | 0.4 | 1.0 | 40 | 200 | 600 | 220 | 1.8 | Occurred | Good | None | Comparative Example |
| 30 | Ni | 4 | 0.4 | 4.0 | 23 | 200 | 600 | 220 | 1.8 | Occurred | Good | None | Comparative Example |
| 31 | Ni | 6 | 8.0 | 3.0 | 40 | 200 | 600 | 220 | 1.8 | None | Surface Crack | None | Comparative Example |
| 32 | Ni | 10 | 0.4 | 2.5 | 58 | 200 | 600 | 220 | 1.8 | Occurred | Good | None | Comparative Example |
| 33 | Ni | 10 | 12.0 | 10.0 | 23 | 200 | 600 | 220 | 1.8 | None | Surface Crack | None | Comparative Example |
| 34 | Ni | 25 | 5.0 | 10.0 | 46 | 200 | 600 | 220 | 1.8 | Occurred | Good | None | Comparative Example |

TABLE 2-continued

| Test No. | Filled Metal | Diameter d (mm) | Thickness H (mm) | Distance P (mm) | Area Ratio ε (%) | Distance R (mm) | Distance L (mm) | Filled Region (mm) | Drawing Speed Vc (m/min) | Cast Piece Surface Crack | State of Mold | Bulging of Cast Piece | Note |
|---|---|---|---|---|---|---|---|---|---|---|---|---|---|
| 35 | Ni | 1.5 | 2.0 | 6.0 | 33 | 200 | 600 | 110 (Upper) | 1.8 | Occurred | Good | None | Comparative Example |
| | | 6 | 2.0 | 6.0 | 23 | | | 110 (Lower) | | | | | |
| 36 | Ni | 6 | 2.0 | 1.0 | 69 | 200 | 600 | 110 (Upper) | 1.8 | Occurred | Good | None | Comparative Example |
| | | 6 | 2.0 | 2.0 | 23 | | | 110 (Lower) | | | | | |
| 37 | Ni | 10 | 15.0 | 10.0 | 23 | 200 | 600 | 110 (Upper) | 1.8 | None | Surface Crack | None | Comparative Example |
| | | 10 | 10.0 | 10.0 | 23 | | | 110 (Lower) | | | | | |
| 38 | — | — | — | — | — | 0 | 900 | 0 | 1.8 | Occurred | Good | None | Conventional Example |

In the case of test Nos. 1 through 16, the diameter (d) and filling thickness (H) of portions filled with a metal of low thermal conductivity were within the range according to the present invention, and the distance (P) between the portions filled with a metal of low thermal conductivity, an area ratio (ε) constituted by the portions filled with a metal of low thermal conductivity, the relationship between a distance (L) between the lower edge of a region in which the portions filled with a metal of low thermal conductivity were formed and the lower edge of the mold and a cast piece drawing speed (Vc), the relationship between a distance (R) between the meniscus and the lower edge of the region in which the portions filled with a metal of low thermal conductivity were formed and the cast piece drawing speed (Vc) and mold powder used were within the preferable range according to the present invention. In the case of these test Nos. 1 through 16, the crack of the mold did not occur and the surface crack on the cast piece did not occur. That is, it is clarified that, in the case of test Nos. 1 through 16, the crack of the mold did not occur and that there was a significant decrease in the number of the surface cracks of a cast piece in comparison to conventional cases even in the case of medium-carbon steel in which a surface crack tends to occur.

In the case of test Nos. 17, 19, 21, and 22, since an area ratio (ε) constituted by the portions filled with a metal of low thermal conductivity was 10% or less, these tests were out of the preferable range according to the present invention. However, since other conditions are within the ranges and preferable ranges according to the present invention, in the case of test Nos. 17, 19, 21, and 22, although small cracks occurred on the surface of the cast piece, it is clarified that there was a significant decrease in the number of surface cracks in comparison to conventional cases.

In the case of test Nos. 18, 20, and 23, the relationship between the distance (P) between the portions filled with a metal of low thermal conductivity and the diameter (d) of the portions filled with a metal of low thermal conductivity is less than the lower limit of the preferable range according to the present invention. However, since other conditions are within the ranges and preferable ranges according to the present invention, in the case of test Nos. 18, 20, and 23, although small surface cracks of the cast piece occurred, it is clarified that there was a significant decrease in the number of surface cracks in comparison to conventional cases.

In the case of test No. 24, since the relationship between the distance (L) and the cast piece drawing speed (Vc) is out of the preferable range according to the present invention, the thickness of a solidified shell immediately under the mold became thin, which resulted in an increase in the amount of bulging deformation immediately under the mold. However, since there was an increase in the thickness of the solidified shell as a result of the surface of the solidified shell being cooled by the second cooling water in a second cooling zone located immediately under the mold, the amount of bulging deformation in the second cooling zone became equivalent to the ordinary amount so that breakout did not occur, which resulted in there being no problem in particular. Since other conditions were in the ranges and preferable ranges according to the present invention, and since the surface crack on the cast piece did not occur, it is clarified that there was a significant decrease in the number of surface cracks in comparison to conventional cases.

In the case of test No. 25, the diameter (d) of the portions filled with a metal of low thermal conductivity was varied within the range according to the present invention in the region within 110 mm from the upper edge of the region and in the region within 110 mm from the lower edge of the region in which the portions filled with a metal of low thermal conductivity were formed. In the case of test No. 25, the filling thickness (H) of portions filled with a metal of low thermal conductivity was within the range according to the present invention, and the distance (P) between the portions filled with a metal of low thermal conductivity, an area ratio (ε) constituted by the portions filled with a metal of low thermal conductivity, the relationship between a distance (L) and a cast piece drawing speed (Vc), the relationship between a distance (R) and the cast piece drawing speed (Vc), and mold powder used were within the preferable range according to the present invention. In the case of test No. 25, the crack of the mold did not occur and the surface crack on the cast piece did not occur.

In the case of test No. 26, the distance (P) between the portions filled with a metal of low thermal conductivity was varied within the range according to the present invention in the region within 110 mm from the upper edge of the region and in the region within 110 mm from the lower edge of the region in which the portions filled with a metal of low thermal conductivity were formed. In the case of test No. 26, the diameter (d) and filling thickness (H) of portions filled with a metal of low thermal conductivity were within the range according to the present invention, and an area ratio (ε) constituted by the portions filled with a metal of low thermal conductivity, the relationship between a distance (L)

and a cast piece drawing speed (Vc), the relationship between a distance (R) and the cast piece drawing speed (Vc), and mold powder used were within the preferable range according to the present invention. In the case of test No. 26, the crack of the mold did not occur and the surface crack on the cast piece did not occur.

In the case of test No. 27, the thickness (H) of the portions filled with a metal of low thermal conductivity was varied within the range according to the present invention in the region within 110 mm from the upper edge of the region and in the region within 110 mm from the lower edge of the region in which the portions filled with a metal of low thermal conductivity were formed. In the case of test No. 27, the diameter (d) of portions filled with a metal of low thermal conductivity was within the range according to the present invention, and an area ratio (ε) constituted by the portions filled with a metal of low thermal conductivity, the relationship between a distance (L) and a cast piece drawing speed (Vc), the relationship between a distance (R) and the cast piece drawing speed (Vc), and mold powder used were within the preferable range according to the present invention. In the case of test No. 27, the crack of the mold did not occur and the surface crack on the cast piece did not occur.

In the case of test Nos. 28 through 37, although portions with a metal of low thermal conductivity are formed on the inner wall surface of the mold, since forming conditions were out of the range according to the present invention, the occurrences of the surface crack on a cast piece and the crack of the mold were not prevented at the same time. In addition, in the case of test No. 38 where portions filled with a metal of low thermal conductivity were not formed, the surface crack on a cast piece occurred.

Example 2

Medium-carbon steel (having a chemical composition containing C: 0.08 to 0.17 mass %, Si: 0.10 to 0.30 mass %, Mn: 0.50 to 1.20 mass %, P: 0.010 to 0.030 mass %, S: 0.005 to 0.015 mass % and Al: 0.020 to 0.040 mass %) was cast using water-cooled copper molds in which portions filled with a metal of low thermal conductivity were formed under various conditions on the inner wall surface, various casting conditions and various kinds of mold powder, and tests were carried out in order to investigate the surface crack on the cast pieces. The inner space of the used water-cooled copper mold had a long side length of 1.8 m and a short side of length 0.26 m.

The distance (=mold length) from the upper edge to the lower edge of the used water-cooled copper mold was 900 mm, and the position of a meniscus when ordinary casting is performed was set to be 100 mm lower than the upper edge of the mold. Firstly, circular concave grooves were formed on the inner wall surface of the mold in the region between a position 80 mm lower than the upper edge of the mold and a position 140 to 300 mm lower than the upper edge of the mold. Subsequently, portions filled with a metal of low thermal conductivity were formed by filling nickel (having a thermal conductivity of 80 W/(m·K)) into the circular concave grooves using a plating method. In the case where the depth of the circular concave grooves was large, portions filled with a metal of low thermal conductivity having the desired shape were formed on the inner wall surface of the mold by repeating plating and surface polishing several times.

Since the position of a meniscus in the mold was set to be 100 mm lower than the upper edge of the mold, the distances (Q), (R), and (L) in FIG. 1 were respectively 20 mm, 40 to 200 mm, and 600 to 760 mm.

Subsequently, the whole inner wall surface of the mold was covered with a coated layer of a Ni—Co alloy so that the coated layer thickness was 0.5 mm at the upper edge of the mold and 1.0 mm at the lower edge of the mold (the thickness of the coated layer of a Ni—Co alloy was about 0.6 mm in the portions filled with a metal of low thermal conductivity).

In a continuous casting operation, mold powder having a basicity ((CaO by mass %)/($SiO_2$ by mass %)) of 0.4 to 1.8 and a crystallization temperature of 920° C. to 1250° C. was used. "Crystallization temperature" means, as described above, a temperature at which mold powder is crystallized in the course of the reheating of vitrified mold powder which has been formed by rapidly cooling molten mold powder. In addition, a cast piece drawing speed when ordinary casting was performed was 1.5 to 2.4 m/min, and the degree of superheat for molten steel in a tundish was 20° C. to 35° C. The position of the meniscus in the mold when ordinary casting is performed was set to be 100 mm lower than the upper edge of the mold and controlled so that the meniscus is present within the region in which the portions filled with a metal of low thermal conductivity were formed and so that the portions filled with a metal of low thermal conductivity are present in the region between a position 20 mm higher than the meniscus and a position 40 mm to 200 mm lower than the meniscus when ordinary casting is performed.

After continuous casting had been finished, the surface on the long side of the cast piece was pickled in order to remove scale, and then the number of occurrences of the surface cracks was determined. The state in which the surface cracks of the cast piece of medium-carbon steel occurred is given in Table 3. The state in which the surface crack on the cast piece occurred was evaluated by comparison to that in the case where medium-carbon steel cast piece was cast using a mold in which portions filled with a metal of low thermal conductivity were not formed. Here, the state in which the surface cracks of the cast piece or a depression (hollow) occurred was evaluated on the basis of a value which was calculated by dividing the length of the portions of a cast piece in which surface cracks or a depression occurred by the length of the cast piece.

TABLE 3

| Test No. | Filled Metal | Diameter d (mm) | Thickness H (mm) | Distance P (mm) | Area Ratio ε (%) | Distance R (mm) | Distance L (mm) | Drawing Speed Vc (m/min) | Mold Powder Basicity | Mold Powder Crystallization Temperature (° C.) | Cast Piece Surface Crack | State of Mold | Break-out Alarm | Note |
|---|---|---|---|---|---|---|---|---|---|---|---|---|---|---|
| 51 | Ni | 2 | 0.5 | 1.5 | 30 | 100 | 700 | 1.5 | 0.80 | 1050 | None | Good | None | Example |
| 52 | Ni | 2 | 1.0 | 2.0 | 23 | 150 | 650 | 1.8 | 0.95 | 1020 | None | Good | None | Example |
| 53 | Ni | 2 | 2.0 | 4.0 | 10 | 150 | 650 | 2.0 | 1.15 | 1100 | None | Good | None | Example |
| 54 | Ni | 4 | 1.0 | 2.5 | 34 | 120 | 680 | 1.5 | 1.00 | 1080 | None | Good | None | Example |

TABLE 3-continued

| Test No. | Filled Metal | Diameter d (mm) | Thickness H (mm) | Distance P (mm) | Area Ratio ε (%) | Distance R (mm) | Distance L (mm) | Drawing Speed Vc (m/min) | Mold Powder Basicity | Mold Powder Crystallization Temperature (° C.) | Cast Piece Surface Crack | State of Mold | Breakout Alarm | Note |
|---|---|---|---|---|---|---|---|---|---|---|---|---|---|---|
| 55 | Ni | 4 | 2.0 | 4.0 | 23 | 100 | 700 | 2.0 | 1.20 | 1000 | None | Good | None | Example |
| 56 | Ni | 4 | 4.0 | 8.0 | 10 | 120 | 680 | 2.4 | 0.85 | 980 | None | Good | None | Example |
| 57 | Ni | 6 | 0.5 | 1.5 | 58 | 80 | 720 | 1.5 | 0.80 | 1050 | None | Good | None | Example |
| 58 | Ni | 6 | 2.0 | 4.0 | 33 | 100 | 700 | 1.8 | 1.05 | 950 | None | Good | None | Example |
| 59 | Ni | 6 | 2.0 | 7.0 | 19 | 150 | 650 | 2.0 | 1.05 | 1020 | None | Good | None | Example |
| 60 | Ni | 6 | 3.0 | 7.0 | 19 | 120 | 680 | 2.0 | 0.90 | 1090 | None | Good | None | Example |
| 61 | Ni | 6 | 6.0 | 12.0 | 10 | 200 | 600 | 2.4 | 0.90 | 960 | None | Good | None | Example |
| 62 | Ni | 10 | 2.0 | 6.0 | 35 | 100 | 700 | 1.8 | 1.10 | 1020 | None | Good | None | Example |
| 63 | Ni | 10 | 4.0 | 12.0 | 19 | 100 | 700 | 2.0 | 1.00 | 1060 | None | Good | None | Example |
| 64 | Ni | 10 | 8.0 | 15.0 | 15 | 150 | 650 | 2.4 | 1.20 | 960 | None | Good | None | Example |
| 65 | Ni | 20 | 2.0 | 12.0 | 35 | 100 | 700 | 2.0 | 0.80 | 1010 | None | Good | None | Example |
| 66 | Ni | 20 | 5.0 | 20.0 | 23 | 100 | 700 | 2.4 | 1.00 | 1060 | None | Good | None | Example |
| 67 | Ni | 4 | 2.0 | 0.8 | 63 | 100 | 700 | 1.5 | 1.10 | 1020 | Little | Good | None | Example |
| 68 | Ni | 6 | 2.0 | 1.4 | 60 | 120 | 680 | 2.0 | 1.00 | 980 | Little | Good | None | Example |
| 69 | Ni | 20 | 4.0 | 4.0 | 63 | 120 | 680 | 2.4 | 1.10 | 970 | Little | Good | None | Example |
| 70 | Ni | 2 | 2.0 | 4.0 | 10 | 100 | 700 | 2.0 | 1.50 | 1150 | Slight Depression, Little | Good | None | Example |
| 71 | Ni | 4 | 2.0 | 5.0 | 18 | 100 | 700 | 2.0 | 1.80 | 1250 | Slight Depression, Little | Good | None | Example |
| 72 | Ni | 6 | 2.0 | 6.0 | 23 | 150 | 650 | 2.0 | 0.40 | 920 | None | Good | Issued | Example |
| 73 | Ni | 6 | 2.0 | 8.0 | 17 | 100 | 700 | 2.4 | 1.50 | 1080 | Slight Depression, Little | Good | None | Example |
| 74 | Ni | 6 | 2.0 | 8.0 | 17 | 120 | 680 | 2.0 | 1.00 | 1180 | Slight Depression, Little | Good | None | Example |
| 75 | Ni | 10 | 4.0 | 12.0 | 19 | 100 | 700 | 1.5 | 1.60 | 1230 | Slight Depression, Little | Good | None | Example |
| 76 | Ni | 6 | 0.5 | 1.5 | 58 | 40 | 760 | 1.5 | 0.90 | 980 | Slight Depression, Little | Good | None | Example |
| 77 | Ni | 6 | 2.0 | 4.0 | 33 | 40 | 760 | 1.8 | 1.00 | 1030 | Slight Depression, Little | Good | None | Example |
| 78 | Ni | 6 | 2.0 | 7.0 | 19 | 50 | 750 | 2.0 | 1.10 | 1040 | Slight Depression, Little | Good | None | Example |

As Table 3 indicates, in the case of test Nos. 51 through 66, the diameter (d) and filling thickness (H) of portions filled with a metal of low thermal conductivity were within the range according to the present invention, and the distance (P) between the portions filled with a metal of low thermal conductivity, an area ratio (ε) constituted by the portions filled with a metal of low thermal conductivity, the relationship between a distance (L) between the lower edge of a region in which the portions filled with a metal of low thermal conductivity were formed and the lower edge of the mold and a cast piece drawing speed (Vc), the relationship between a distance (R) between the meniscus and the lower edge of the region in which the portions filled with a metal of low thermal conductivity were formed and the cast piece drawing speed (Vc) and mold powder used were within the preferable range according to the present invention. In the case of these test Nos. 51 through 66, the crack of the mold did not occur and the surface crack on the cast piece did not occur. That is, it is clarified that, in the case of test Nos. 51 through 66, the crack of the mold did not occur, that breakout did not occur, and that there was a significant decrease in the number of the surface cracks of the cast piece in comparison to conventional cases even in the case of medium-carbon steel in which a surface crack tends to occur.

In the case of test Nos. 67, 68, and 69, the distance (P) between the portions filled with a metal of low thermal conductivity was out of the preferable range according to the present invention. However, other conditions are within the ranges and preferable ranges according to the present invention. In the case of these tests, although small surface cracks of the cast piece occurred, it is clarified that there was a significant decrease in the number of surface cracks in comparison to conventional cases.

In the case of test Nos. 70, 71, and 75, the crystallization temperature and basicity of the used mold powder were out of the preferable range according to the present invention. However, other conditions are within the ranges and preferable ranges according to the present invention. In the case of these tests, although the slight depression and small surface cracks of the cast piece occurred, it is clarified that there was a significant decrease in the number of surface cracks in comparison, to conventional cases.

In the case of test No. 72, the basicity of the used mold powder was out of the preferable range according to the present invention. However, other conditions are within the ranges and preferable ranges according to the present invention. In the case of this test, although a breakout alarm was activated, breakout did not occurred. In the case of this test, since the crack of the mold did not occur, and since the surface crack on the cast piece did not occur, it is clarified that there was a significant decrease in the number of surface cracks in comparison to conventional cases.

In the case of test No. 73, the basicity of the used mold powder was out of the preferable range according to the present invention, and in the case of test No. 74, the crystallization temperature of the used mold powder was out of the preferable range according to the present invention. However, other conditions are within the ranges and preferable ranges according to the present invention. In the case of test Nos. 73 and 74, although the slight depression and small surface cracks of the cast piece occurred, it is clarified that there was a significant decrease in the number of surface cracks in comparison to conventional cases.

In the case of test Nos. 76 through 78, the relationship between a distance (R) and a cast piece drawing speed (Vc) was out of the preferable range according to the present invention. However, other conditions are within the ranges and preferable ranges according to the present invention. In the case of these tests, although the slight depression and small surface cracks of the cast piece occurred, it is clarified that there was a significant decrease in the number of surface cracks in comparison to conventional cases.

REFERENCE SIGNS LIST

1 copper plate on the long side of mold
2 circular concave groove
3 portion filled with a metal of low thermal conductivity
4 coated layer
5 flow channel of cooling water
6 back plate

The invention claimed is:

1. A continuous casting copper mold, the copper mold comprising a plurality of separate portions filled with a metal of low thermal conductivity, the separate portions being formed by filling the metal of low thermal conductivity into circular concave grooves and/or quasi-circular concave grooves, the metal of low thermal conductivity having a thermal conductivity that is 30% or less than the copper of the copper mold at a temperature after the mold has been solidified and cooled completely in manufacturing the mold, the circular concave grooves having a diameter from 2 mm to 20 mm and the quasi-circular concave grooves having an equivalent circle diameter from 2 mm to 20 mm, and the circular concave grooves and the quasi-circular concave grooves being formed in a region on an inner wall surface of the copper mold defined by (i) a position higher than a meniscus and (ii) a position 20 mm or more lower than the meniscus, wherein a filling thickness of the metal of low thermal conductivity in the separate portions is equal to or less than a depth of the circular concave grooves or the quasi-circular concave grooves, and satisfies relationship (1):

$$0.5 \leq H \leq d \quad (1),$$

where H represents the filling thickness (mm) of the metal of low thermal conductivity and d represents the diameter (mm) or equivalent circle diameter (mm) of the separate portions, the inner wall surface of the copper mold is coated with a Ni-alloy layer having a thickness of 2.0 mm or less, the separate portions filled with the metal of low thermal conductivity are covered with the Ni-alloy layer, the plurality of separate portions are formed throughout the region on the inner wall surface, and a distance in a casting direction between a lower edge of the region and a lower edge of the copper mold satisfies relationship (2):

$$L \geq Vc \times 100 \quad (2),$$

where L represents the distance (mm) between the lower edge of the region and the lower edge of the copper mold and Vc represents a cast piece drawing speed (m/min) when casting is performed.

2. The continuous casting copper mold according to claim 1, wherein a closest distance between immediately adjacent portions of the plurality of separate portions satisfies relationship (3):

$$P \geq 0.25 \times d \quad (3),$$

where P represents the closest distance (mm) between the immediately adjacent portions and d represents the diameter (mm) or equivalent circle diameter (mm) of the separate portions.

3. The continuous casting copper mold according to claim 2, wherein the closest distance between the immediately adjacent portions varies among the plurality of separate portions in width direction and/or casting direction.

4. The continuous casting copper mold according to claim 1, wherein the separate portions constitute 10% or more of the area of the region on the inner wall surface of the copper mold.

5. The continuous casting copper mold according to claim 1, wherein diameters or equivalent circle diameters of the separate portions vary among the plurality of separate portions in a width direction or casting direction within the range from 2 mm to 20 mm.

6. The continuous casting copper mold according to claim 1, wherein thicknesses of the separate portions vary among the plurality of separate portions in width direction or casting direction within the range satisfying relationship (1).

7. A method for continuously casting steel, the method comprising using the continuous casting copper mold according to claim 1 and continuously casting molten steel by injecting the molten steel in a tundish into the continuous casting copper mold.

8. The method for continuously casting steel according to claim 7, wherein the region in which the separate portions are formed throughout extends from a position lower than the meniscus to a distance from the meniscus equal to or more than a distance (R) derived using relationship (4) depending on a cast piece drawing speed when casting is performed, the cast piece drawing speed when casting is performed being 0.6 m/min or more and a mold powder having a crystallization temperature of 1100° C. or lower and a basicity ((CaO by mass %)/($SiO_2$ by mass %)) of 0.5 or more and 1.2 or less being used:

$$R = 2 \times Vc \times 1000/60 \quad (4),$$

where R represents the distance (mm) from the meniscus and Vc represents the cast piece drawing speed (m/min) when casting is performed.

9. The method for continuously casting steel according to claim 7, wherein the molten steel of a medium-carbon steel having a C content in the range from 0.08 mass % to 0.17 mass % is continuously cast at a cast piece drawing speed of 1.5 m/min or more to form a cast slab having a thickness of 200 mm or more.

10. The continuous casting copper mold according to claim 1, wherein the separate portions are formed by filling the metal of low thermal conductivity into the circular concave grooves and/or quasi-circular concave grooves with a plating means or thermal spraying means.

11. The continuous casting copper mold according to claim 1, wherein the copper of the copper mold has a thermal conductivity of 380 W/(m·K).

* * * * *